United States Patent [19]

Raasch

[11] 4,156,341

[45] May 29, 1979

[54] APPARATUS FOR MONITORING SLIVER FEED IN A SPINNING MACHINE

[75] Inventor: Hans Raasch, Mönchen-Gladbach, Fed. Rep. of Germany

[73] Assignee: W. Schlafhorst & Co., Mönchen-Gladbach, Fed. Rep. of Germany

[21] Appl. No.: 680,052

[22] Filed: Apr. 26, 1976

[30] Foreign Application Priority Data

Apr. 24, 1975 [DE] Fed. Rep. of Germany ..... 2518224

[51] Int. Cl.[2] ..... D01H 13/16

[52] U.S. Cl. ..... 57/263; 57/58.95; 57/83

[58] Field of Search ..... 57/34 R, 58.95, 80, 57/81, 83; 19/0.23, 0.24, 0.25, 239

[56] References Cited

U.S. PATENT DOCUMENTS

| | | | |
|---|---|---|---|
| 2,694,907 | 11/1954 | Moore | 19/0.25 X |
| 3,010,273 | 11/1961 | Bailey | 19/0.25 X |
| 3,124,843 | 3/1964 | Adams et al. | 19/0.25 |
| 3,854,274 | 12/1974 | Bartling | 57/34 R |

*Primary Examiner*—Richard C. Queisser
*Assistant Examiner*—Charles Gorenstein
*Attorney, Agent, or Firm*—Herbert L. Lerner

[57] ABSTRACT

Device for monitoring the feeding of a fiber sliver in a spinning machine having a device for feeding the fiber sliver thereto and a device for loosening the fibers of the sliver prior to spinning the fibers into a thread includes a device for detecting the presence and absence of the fiber sliver at a location forward of the fiber-loosening device along a path of travel of the fiber sliver from the device for feeding the fiber sliver to the device for loosening the fibers of the sliver, the fiber-loosening device having an inlet for the fiber sliver being fed thereto, and the sliver detecting device being located a distance at least equal to a staple length of the fibers of the sliver from the inlet of the fiber-loosening device.

9 Claims, 3 Drawing Figures

APPARATUS FOR MONITORING SLIVER FEED IN A SPINNING MACHINE

BACKGROUND OF THE INVENTION

1. Field of the Invention

The invention relates to apparatus for monitoring the feeding of a sliver or band of fiber in a spinning machine.

2. Description of the Prior Art

In the event of a break of a fiber sliver or band in an open-ended (OE) spinning frame, or if the sliver should run out, several meters of yarn, or thread, of very different relative count or number may be spun, because the oncoming remaining sliver does not have the normal number or count. In most cases, the fiber sliver is narrower at the location of the break therein. The operator or servicing personnel would then have to pull off several meters of spun yarn or thread from the take-up coil or bobbin, in order to ensure that the section of yarn or thread with the wrong count is removed.

Generally, in open-ended or OE spinning frames having a device which automatically corrects or repairs yarn or thread breaks, a suction nozzle is used to search for the end of the yarn or thread on the take-up bobbin, and approximately one meter of yarn is withdrawn therefrom. In the case of a break in the spun yarn caused by a break in the fiber sliver, in order to ensure that the entire length of incorrect count is withdrawn, the device for correcting or repairing the yarn break usually removes a very long length of yarn. This would be unnecessary, in most cases, however.

SUMMARY OF THE INVENTION

It is therefore an object of the invention of the instant application to provide such a device which avoids the difficulties that occur as a result of a break in the fiber sliver or band and to shorten the time lost due to a failure in the feeding operation.

With the foregoing and other objects in view, there is provided in accordance with the invention, a device for monitoring the feeding of a fiber sliver in a spinning machine having means for feeding the fiber sliver thereto and means for loosening the fibers of the sliver prior to spinning the fibers into a thread, comprising means for detecting the presence and absence of the fiber sliver at a location forward of the fiber-loosening means along a path of travel of the fiber sliver from the means for feeding the fiber sliver to the means for loosening the fibers of the sliver.

In accordance with another feature of the invention, the fiber-loosening means have an inlet for the fiber sliver being fed thereto, and the sliver detecting means are located a distance at least equal to a staple length of the fibers of the sliver from the inlet of the fiber-loosening means.

In accordance with a further feature of the invention, the device includes means for stopping the feeding of the fiber sliver upon detection of the absence of the fiber sliver by the sliver detecting means.

In accordance with an added feature of the invention where the spinning machine is located at a winding station, the fiber-feed stopping means is a shut-off device for the winding station.

In accordance with an alternate feature of the invention, the fiber-feed stopping means is a shut-off device for the fiber loosening means.

As soon as the detecting means has ascertained or sensed that the fiber sliver is no longer present, the feeding of the fibers is immediately interrupted or the spinning station is stopped.

As mentioned hereinbefore, spinning frames or machines are known which contain a device for automatically correcting or repairing a break in the spun yarn or thread. A yarn or thread break can also be caused by a preceding break in the incoming fiber band or sliver. In such a case, an attempt by the automatic device to repair the yarn or thread break could not, therefore, be successful. In order to prevent beforehand the making of such an unsuccessful attempt, there are provided in accordance with a further feature of the invention, means operatively connected to the sliver detecting means for indicating the detection of the absence of the fiber sliver by the sliver detecting means.

As an alternate feature of the invention, the spinning machine further includes means for spinning the loosened fibers of the sliver into a thread, means for detecting the presence and absence of the thread being spun by the spinning means, and means for automatically repairing a break in the thread, and the device includes means operatively connected to the sliver detecting means for preventing operation of the automatic repairing means upon the detection of the absence of the fiber sliver by the sliver detecting means.

In accordance with yet another feature of the invention, both the means for preventing operation of the automatic repairing means, as well as the means for indicating the detection of the absence of the fiber sliver by the sliver detecting means are operatively connected to the sliver detecting means.

The indicating device thus immediately signals a break in the incoming fiber sliver, so that it can be corrected or repaired optionally either manually or automatically.

After the fiber sliver break has been corrected or repaired, the thread is joined again as fast as possible and the thread or yarn break is thereby eliminated.

In accordance with yet a further feature of the invention, the device includes means for manually initiating operation of the means for automatically repairing a break in the thread, and means for repetitively operating the automatic repairing means.

In accordance with a concomitant feature of the invention, the device includes means for actuating the means for preventing operation of said automatic repairing means after recurrence of a predetermined number of repetitive unsuccessful operations of the automatic repairing means.

Repetition of the joining attempts accelerates the resumption of the normal operation of the spinning station. Experience has found that the thread or yarn joining operation is not always successful on the first attempt. If the joining of the thread is not successful after five attempts at most, it must be assumed that a fault probably exists which can only be determined and corrected after thorough inspection. The joining attempts are therefore then again interrupted and a trouble indicator is energized.

Special advantages that are obtainable with the invention are that the production of yarn of incorrect number or count is prevented by the device of the invention if there should be a failure in the feeding of the fiber sliver or band. Unsuccessful joining attempts of an automatic thread joining device are also avoided, and the interruption of the operation of the spinning machine due to the failure of the fiber sliver feed is kept as short as possible.

Other features which are considered as characteristic for the invention are set forth in the appended claims.

Although the invention is illustrated and described herein as embodied in an apparatus for monitoring sliver feed in a spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic sectional view of a spinning station of an open-ended (OE) spinning machine or frame equipped with a device for monitoring sliver feed in accordance with the invention;

FIG. 2 is a diagrammatic side elevational view of an open-ended (OE) spinning machine and winding unit with a traveling carriage for a joining device for automatically correcting or repairing breaks in the thread or yarn spun by the spinning machine and showing the spinning station of FIG. 1 in reduced scale; and FIG. 3 is an electric circuit diagram of the system for operating the device of the invention in cooperation with the spinning and winding units and the joining carriage.

DESCRIPTION OF THE PREFERRED EMBODIMENT

Figure 1:
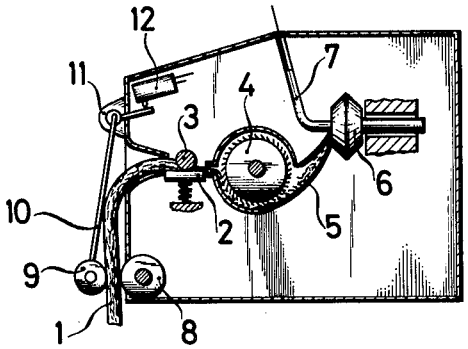

Referring now to the drawing and first, particularly to FIG. 1 thereof, there is shown a spinning station wherein a fiber band or sliver of relatively fine loosely packed fibers or filaments 1 is transported between a claimping table 2 and the drawing-in or feed roller 3 to an opening or loosening-up cylinder 4 and is loosened or broken up by the latter. The individual fibers enter a rotor 6 through a fiber guide channel 5. A thread is then formed in the rotor 6 and is withdrawn through a withdrawal tube 7, so that it can be wound on a non-illustrated take-up device. The sliver 1 is pulled out of a supply container, now shown in FIG. 1 but shown at the bottom of FIG. 2, and is led between a pair of rollers 8 and 9. The roller 8 is firmly connected to the spinning machine and can be driven with the same peripheral velocity as that of the feed roller 3. The roller 9 is articulatingly mounted or hinged by a lever 10. The lever 10 has a projection or extension arm 11 which acts upon a switch 12. If no sliver or fiber band passes any longer between the rollers 8 and 9, the roller 9 pivots into engagement with the roller 8, and the switch 12 is accordingly closed due to the depression of a push button by the arm 11. The switch 12 forms part of the system shown schematically in detail in FIG. 3, which controls the loosening-up device 3, 4, 5.

The sliver or roving 1, for example, has a thickness or diameter of about 3 to 5 cm. The distance between the rollers 8, 9 on the one hand, and the feed roller 3, on the other hand is advantageously at least equal to the staple length of the fibers of the sliver 1, for example substantially 3.8 to 15.2 cm. Although not specifically shown in the figures, the distance between the sensing roller 9 and the feed roller 3 may be readily adjustable by any conventional means to accommodate slivers having fibers of varying staple lengths.

It is furthermore noted, that if a break were to occur in the sliver 1, it would usually not be a "clean" break but one wherein part of the trailing length of the sliver 1 remaining secured by the roller 3 would have a reduced fiber count. Consequently if the distance between the rollers 8, 9, on the one hand, and the feed roller 3, on the other hand, were less than the staple length, part of the trailing length of reduced fiber count would travel beyond the roller 3 and into the region of the loosening-up cylinder 4 before shut-down of the sliver feed would occur. However, by providing a length at least equal to the staple length of the fiber of the sliver, the portion having a reduced count would remain accessible for removal upstream of the feed roller 3 in travel direction of the sliver 1.

Figure 2:
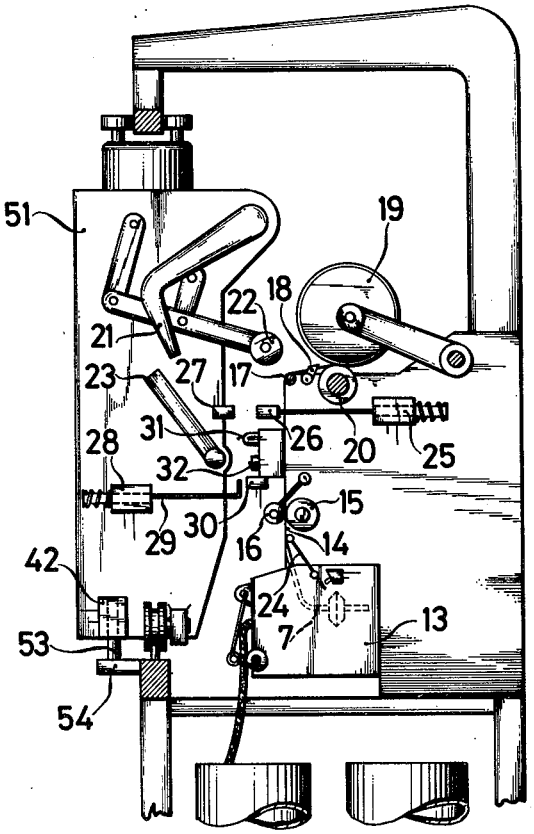

FIG. 2 is a diagrammatic simplified side view of an open-ended (OE) spinning frame with a traveling device 51 for automatically repairing thread breaks. This traveling device 51 is hereinafter referred to as the piecing or joining carriage. Also shown in FIG. 2 is a spinning device 13, from which a thread 14 is drawn by a withdrawal cylinder 15 in cooperation with a pressure roller 16. The thread 14 runs over a deflecting wire 17 and a thread guide 18 onto a cross-wound coil or cheese 19. The cross-wound coil 19 is driven by a winding cylinder or roller 20. The joining carriage 51 travels back and forth in front of the individual spinning and winding stations of a textile machine. The essential operating elements of the joining carriage 51 are a suction nozzle 21, which, upon the occurrence of a break in the thread, withdraws the thread from the cross-wound coil or bobbin 19; a reversing or return motion roller 22, which drives the cross-wound bobbin 19 in unwinding direction during the thread-seeking operation; and a conventional thread feeder arm 23, which brings the thread from the suction nozzle 21 to the thread delivery tube 7. A thread monitor 24 has a feeler which engages or rests against the running thread just above the opening of the thread delivery tube 7, as viewed in FIG. 2. When a thread break occurs, the feeler of the monitor 24 swings downwardly about its pivot to shut off a switch suitably connected to the drive mechanism for the feed roller 8 and thereby shuts off the feeding of the fibers. If a thread break is registered, voltage is applied to an electromagnetic actuator 25, so that a plunger or tappet 26, which is connected with the magnetic actuator 25, is moved to the left so as to be able to act upon a switch 27. A signal is thereby given to the joining carriage 51 that a thread break must be corrected at this spindle. An electromagnetic actuator 28 is carried by the joining carriage 51. Voltage is applied to this magnetic actuator 28 if the joining carriage 51 has made several unsuccessful joining attempts at the respective spindle, and further attempts at joining at this spindle are to be blocked. The electromagnetic actuator 28 moves a push rod 29 to the right-hand side as viewed in FIG. 2 so as to act upon a switch 30. By actuating this switch 30 so that the contact 55 engages the contact 56 (FIG. 3), the electromagnetic actuator 25 is deenergized and the signal light 31 is switched on. By pressing the button 32, the operator can cancel the trouble signal 31.

Figure 3:
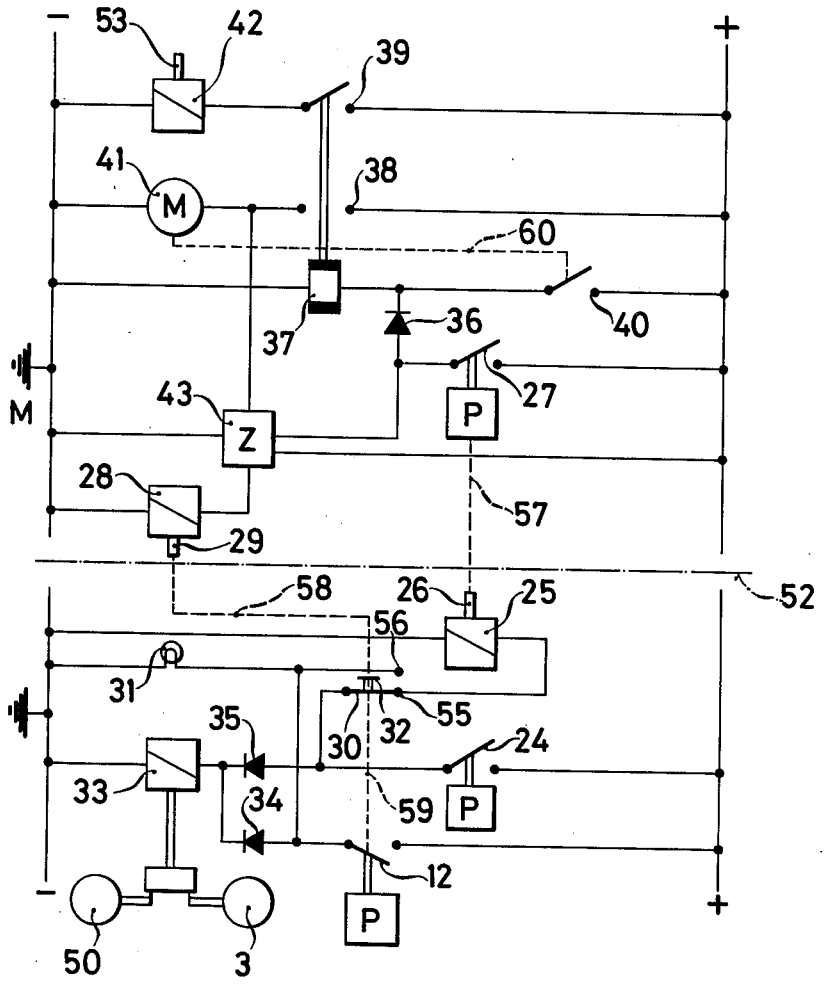

The interaction or cooperation between the joining carriage 51 and the spinning and winding unit is explained in greater detail with reference to the electrical circuit diagram as shown in FIG. 3.

That part of the circuit diagram of FIG. 3 shown above the dot-dash dividing line 52 belongs to the joining carriage 51 and that part of the circuit diagram located below the dividing line 52 to the spinning and winding unit. FIG. 3 shows further switching and operating elements in addition to those shown in FIGS. 1 and 2 and described in connection therewith.

When the switch 12 is closed by the arm 11 of the fiber sliver sensing device formed of the lever 10 and the roller 9 (FIG. 1), voltage to ground M is applied through a diode 34 to the electromagnetic coupling or control device 33, such as a solenoid. The feed roller 3 of the fiber loosening or break-up device 3, 4, 5 (FIG. 1) is thereby disengaged from the drive 50 thereof, so that the supply of the fiber sliver is halted. Simultaneously, voltage is applied also to the indicator lamp 31, which lights up to indicate the existence of trouble. No call-up of the joining carriage 51 is made in this case, since the switch 30 is connected through its contact 55 to the contact 56 by an operative connection or mechanical coupling represented by the broken line 59. Furthermore, a subsequent thread break signal cannot then switch on the electromagnetic actuator 25 through the switch 24.

In the event of a normal thread break without disturbance or disruption of the fiber sliver feed, the switch 12 remains open. The thread break signal is then applied through the thread monitor switch 24. As soon as the switch 24 is closed, the electromagnetic actuator 25 is energized through the closed switch 30 i.e. in the position thereof shown in FIG. 3, and the plunger 26 of the stationary spinning station is pushed forward. When the joining carriage 51 travels past the spinning station, the plunger 26 actuates the switch 27 of the joining carriage 51, as indicated by a broken line 57 which represents operative engagement therebetween. As soon as the switch 27 is closed, voltage is applied to the coil of a relay 37 through a diode 36, so that contacts 38 and 39 are closed. An electromagnetic actuator 42, such as a solenoid, is energized through the contact 39, and a bolt 53 of the actuator 42 is then moved into a detent 54 provided on the stationary spinning station, as shown in FIG. 2, and thereby locks the joining carriage 51 to the spinning station.

Simultaneously, a motor 41 forming part of the automatic mechanism of the joining carriage 51 is energized through the contact 38, the carriage 51 closing the automatic latching contact 40 through an operative connection or mechanical coupling 60, after a brief delay, so that the relay 37 remains energized even when the thread monitor or switch 24 is opened again. Opening of the switch 24 occurs when the thread feeder arm 23 has introduced the thread into the delivery tube 7, and fibers are being fed-in to be joined.

If the full program or cycle for a joining attempt has run its course in the joining carriage 51, the switch 40 then opens and when the joining attempt has been successful, the relay 37 releases. The contacts 38 and 39 are opened and the joining carriage 51 can travel farther along its travel path. If the joining attempt has not been successful, the mgnetic actuator 25 is then re-energized and the switch 27 is closed before the switch 40 is opened. This occurs because the switch 24 closes again after the thread feeder arm 23 has swung away from the delivery tube 7 and no thread is present to hold the feeler of the thread monitor or switch 24 in place. In that case, the automatic joining mechanism of the joining carriage 51 runs through another joining program or cycle. Each time the switch 27 is closed, a counting pulse is fed to a counter 43, and each time the line to the motor 41 is opened i.e. currentless, the counter 43 is reset.

As soon as the storage locations set in the counter 43 are cancelled i.e. after two to five joining attempts, the counter 43 transmits an output signal to the electromagnetic actuator 28 which causes the switch 30 to switch over from the contact 55, as shown in FIG. 3, to the contact 56 through the mechanical or operative connection represented by the broken line 58. Voltage is thereby applied to the signal light 31 through the switches 24 and 30. Illumination of the signal light 31 signals trouble.

As soon as the operator or servicing personnel has corrected the trouble, he depresses the button 32 to set the switch 30 manually back to engagement with the contact 55 so to reactivate the joining carriage 51 for the next joining operation.

In the event of a disturbance in the feeding of the fiber sliver, the joining carriage 51 is not summoned, since the switch 24 is not yet closed initially and the switch 30 is opened when the switch 12 is closed.

After the fiber sliver break is corrected or eliminated, the joining carriage 51 is summoned by the operator by pressing the button 32 of the switch 30, so that the electromagnetic actuator 25 is energized through the closed switches 24 and 30. Conversely, in the event of a thread break without any disruption of the fiber sliver feed, the feed roller or cylinder and, thus, the fiber sliver feed are stopped, because voltage is applied to the electromagnetic clutch 33 through the closed switch 24 and the diode 35.

The operation of all of the important components has been described in detail in connection with the invention because of the importance of the cooperation of the spinning station, the fiber sliver monitor system, the thread monitor system and the automatic joining device.

As noted hereinbefore, the invention is not limited to the described and illustrated embodiment, but rather, other embodiments are conceivable within the scope of the claims and other information furnished in the specification.

What is claimed is:

1. Device for monitoring the feeding of a fiber sliver in a spinning machine having means for feeding the fiber sliver thereto and means for loosening the fibers of the sliver prior to spinning the fibers into a thread, comprising means for detecting the presence and absence of the fiber sliver at a location forward of the fiber-loosening means along a path of travel of the fiber sliver from a source of supply of the fiber sliver to the means for feeding the fiber sliver and the means for loosening the fibers of the sliver, said fiber-loosening means having an inlet for the fiber sliver being fed thereto, and said sliver detecting means being located a distance at least equal to a staple length of the fibers of the sliver from said inlet of said fiber-loosening means.

2. Device according to claim 1 including means for stopping the feeding of the fiber sliver upon detection of the absence of the fiber sliver by said sliver detecting means.

3. Device according to claim 2 wherein the spinning machine is located at a winding station and said fiber-feed stopping means is a shut-off device for the winding station.

4. Device according to claim 2 wherein said fiber-feed stopping means is a shut-off device for the fiber loosening means.

5. Device according to claim 2 including means operatively connected to said sliver detecting means for indicating when absence of the fiber sliver has been detected by said sliver detecting means.

6. Device for monitoring the feeding of a fiber sliver in a spinning machine having means for feeding the fiber sliver thereto, means for loosening the fibers of the sliver, means for spinning the loosened fibers of the sliver into a thread, means for detecting the presence and absence of the thread being spun by the spinning means, and means for automatically repairing a break in the thread, the device comprising means for detecting the presence and absence of the fiber sliver at a location forward of the fiber loosening means along a path of travel of the fiber sliver from a source of supply of the fiber sliver to the means for feeding the fiber sliver and the means for loosening the fibers of the sliver, means for stopping the feeding of the fiber sliver upon detection of the absence of the fiber sliver by said sliver detecting means, and means operatively connected to said sliver detecting means for preventing operation of said automatic repairing means upon the detection of the absence of the fiber sliver by said sliver detecting means.

7. Device according to claim 6 wherein means for indicating when absence of the fiber sliver has been detected by said sliver detecting means are also operatively connected to said sliver detecting means.

8. Device according to claim 6 including means for manually initiating operation of the means for automatically repairing a break in the thread, and means for repetitively operating the automatic repairing means.

9. Device according to claim 7 including means for actuating said means for preventing operation of said automatic repairing means after recurrence of a predetermined number of repetitive unsuccessful operations of said automatic repairing means.

* * * * *